United States Patent [19]

Paniri et al.

[11] 4,081,602

[45] Mar. 28, 1978

[54] SELF-SUPPORTING CABLE

[75] Inventors: Zvi Paniri, Scarborough; Thomas H. Rudd, Toronto, both of Canada

[73] Assignee: Canada Wire and Cable Limited, Toronto, Canada

[21] Appl. No.: 663,496

[22] Filed: Mar. 3, 1976

[30] Foreign Application Priority Data

Apr. 18, 1975 Canada ..... 224990

[51] Int. Cl.[2] ..... H01B 7/18

[52] U.S. Cl. ..... 174/103; 174/70 R; 174/115; 174/117 R

[58] Field of Search ..... 174/116, 115, 103, 104, 174/117 R, 70 R, 41

[56] References Cited

U.S. PATENT DOCUMENTS

| | | | |
|---|---|---|---|
| 2,722,237 | 11/1955 | Rosel | 174/117 R |
| 2,851,515 | 9/1958 | Kolmorgen et al. | 174/117 R |
| 3,020,334 | 2/1962 | Riley | 174/116 X |
| 3,549,788 | 12/1970 | Apen | 174/115 X |
| 3,614,300 | 10/1971 | Wilson | 174/115 |
| 3,728,474 | 4/1973 | Arnaudin, Jr. | 174/115 |

FOREIGN PATENT DOCUMENTS

| | | | |
|---|---|---|---|
| 747,691 | 4/1956 | United Kingdom | 174/41 |

*Primary Examiner*—Arthur T. Grimley
*Attorney, Agent, or Firm*—Fleit & Jacobson

[57] ABSTRACT

A self-supporting cable, more particularly a vertical riser, borehole, dredger and mine shaft cable is disclosed. The self-supporting cable comprises a cable core, a jacket surrounding the cable core and having one or two diametrically opposed sections of increased thickness, and at least one supporting member totally embedded in each jacket section of increased thickness and disposed parallel to the longitudinal axis of the cable. The supporting member preferably consists of wire ropes made of plural elementary strands wound around a central strand, each strand comprising plural individual wires twisted together.

8 Claims, 1 Drawing Figure

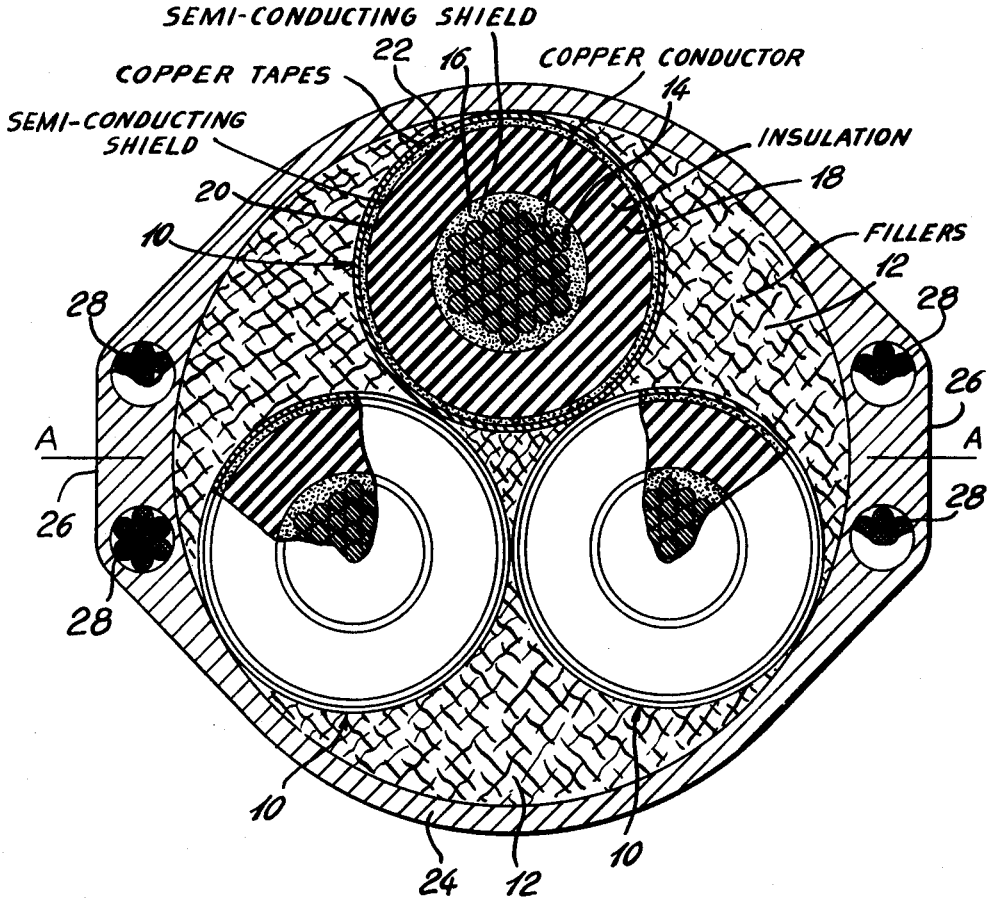
SEMI-CONDUCTING SHIELD
22
16
COPPER CONDUCTOR
COPPER TAPES
14
SEMI-CONDUCTING SHIELD
INSULATION
18
20
FILLERS
10
12
28
28
26
A
A
26
28
28
10
10
24
12

SELF-SUPPORTING CABLE

This invention relates to self-supporting cables and more particularly to vertical riser, borehole, dredger and mine shaft (where allowed by governing standards) cables.

The conventional design of vertical riser, borehole, dredger and mine shaft cables usually comprises one or more insulated conductors cabled together with fillers to make up a so-called cable core and the cable core is covered with helically applied steel or aluminum armour wires. The armour wires provide virtually 100% coverage over the cable core in order to avoid clustering and birdcaging of the armour wires.

This conventional design suffers from the following drawbacks:

a. cable twisting after installation, due to residual torsional force created during the armouring operation;

b. the heavy weight of metal armour (especially steel) creates the need for increase in armour content to support itself as well as the cable (i.e., low strength-to-weight ratio);

c. high manufacturing cost due to the slow armouring operation, and hand application of band-it clamps every 5 ft. or so;

d. high shipping cost;

e. difficulty in installation due to heavy weight.

To overcome the cable twisting problem in the laying down of submarine cables, it has been proposed in U.S. Pat. No. 3,115,542 issued Dec. 24, 1963 to embed a plurality of wire strands in the jackets surrounding the cable core. Such strands are disposed parallel to one another and to the axis of the cable around the circumference of the cable. However, this arrangement is not suitable for vertical riser, borehole, dredger and mine-shaft cables because such cables have to be wound on take-up reels.

It will be easily understood that cables with longitudinal wires embedded all around the jacket are not too flexible and could certainly not be wound on small diameter take-up reels.

It is therefore the object of the present invention to provide a self-supporting cable which substantially overcomes all the problems of the conventional vertical riser, borehole, dredger and mine-shaft cables and, in addition, can be easily wound on take-up reels.

The self-supporting cable, in accordance with the invention, comprises a cable core, a jacket surrounding the cable core and having one or two diametrically opposed sections of increased thickness, and at least one supporting member totally embedded in each jacket section of increased thickness and disposed parallel to the longitudinal axis of the cable.

The supporting members are preferably wire ropes, consisting of plural elementary strands wound around a central strand, each strand comprising plural individual wires twisted together. Preferably, two wire ropes of galvanized steel are used per jacket section of increased thickness.

The cable core may consist of plural power conductors stranded together and of a filler located in the intersticial space between the conductors. Each conductor is usually made of a plurality of copper wires stranded together, a first semi-conducting shield applied over the copper wires, a layer of insulating material applied over the first shield, a second semi-conducting shield applied over the insulating layer and copper tapes applied over the second shield. For low voltage cables, the semi-conducting shields and copper tapes are not required.

The filler is generally made of polypropylene, jute, rubber or other suitable materials.

The jacket is preferably made from polyvinyl chloride, polyethylene, neoprene, chlorosulphonated polyethylene, polyurethane or natural rubber.

The invention will now be disclosed, by way of example, with reference to a preferred embodiment illustrated in the accompanying drawing.

Referring to the drawing, there is shown a cable in accordance with the invention. The cable core comprises three conductors 10 stranded together and rounded up with fillers 12. Suitable fillers include jute, synthetic or natural rubber and polypropylene. Each phase conductor consists of a plurality of soft, bare or tinned copper wires 14 surrounded by a first semi-conducting shield 16. The shield 16 is surrounded by a thick layer of insulating material 18 itself covered with a second semi-conducting shield 20. Finally, copper tapes 22 are applied over the shield 20. For low voltage cables, shields 16 and 20 and copper tapes 22 are not required. The insulating material 18 may consist of ethylene-propylene rubber, crossed-linked polyethylene, butyl or other suitable insulating materials. The semi-conducting shields 16 and 20 may consist of the same material as the insulation 18 but containing a predetermined amount of carbon black to render the insulation semi-conducting and so constitute a shield for the conductor in known manner. The semi-conducting shields 16 and 20 may also be a semi-conducting tape. The above disclosed conductors and fillers are conventional and may be manufactured following well-known techniques. It is also to be understood that the design of the above cable core may vary and that the invention is not limited to the above diclosed cable core.

The cable core so far disclosed is covered by an outer jacket 24 provided with two diametrically opposed sections 26 of increased thickness. Such jacket may be made of thermoplastic material such as polyvinyl chloride, polyethylene, or polyurethane, or of thermosetting material such as neoprene, chlorosulphonated polyethylene, or natural rubber. Two cable supporting members in the form of wire ropes 28 are totally embedded into each portion 26 of the jacket. Such wire ropes may be made of galvanized steel and preferably consist of plural elementary strands wound around a central strand, each strand comprising plural individual wires twisted together. It is to be understood that the number of strands depends on the size and weight of the cable. The number of wire ropes in the jacket also depends on the size and weight of the cable.

It is also to be understood that the thickness of the jacket 24 varies with the size of the cable and that the thickness of the section 26 of the cable also depends on the size of the wire rope embedded into it.

The wire ropes and the jacket are preferably applied in one operation. The wire ropes are paid off from bobbins mounted on jacks ahead of an extruder. With special guides and extrusion dies, the wire ropes are embedded in the jacket via pressure extrusion. Thus, the wire ropes form an integral part of the jacket. When stranded wire ropes are used, the intersticial space between the several strands allows proper keying of the strands to the jacket.

It will be easily understood that, when the cable is wound on a take-up reel, it will easily bend around the axis A-A of the cable as shown in the drawing and, consequently, facilitate winding of the cable around a take-up reel of relatively small diameter. In addition, longitudinal application of the wire ropes will prevent twisting as normally experienced with helical armoured wires.

Although the invention has been disclosed with reference to the preferred embodiment illustrated in the drawing, it is to be understood that the cable core is not limited to the design disclosed. Furthermore, any type of supporting members such as glass fibers may be used in the jacket and the invention is not limited to the use of wire ropes. Finally, any number of supporting members may be used depending on the size and weight of the cable.

What is claimed is:

1. A self-supporting power cable comprising:

a. a cable core consisting of plural electrically conductive power conductors stranded together, and a filler located in the intersticial space between the conductors;

b. a unitary jacket surrounding said cable core, contacting said cable core about the entire periphery thereof, and having two diametrically opposed portions of increased overall cross-sectional thickness; and c. at least one supporting member totally embedded into each diametrically opposed portion of increased overall thickness and disposed parallel to the longitudinal axis of the cable.

2. A self-supporting cable as defined in claim 1, wherein said supporting member is a wire rope consisting of plural elementary strands wound around a central strand, each strand comprising plural individual wires twisted together.

3. A self-supporting cable as defined in claim 2, wherein the wire rope is made of galvanized steel.

4. A self-supporting cable as defined in claims 1, wherein there are two wire ropes per jacket portion of increased overall thickness.

5. A self-supporting cable as defined in claim 1, wherein each conductor consists of a plurality of copper wires and a layer of insulating material applied over said copper wires.

6. A self-supporting cable as defined in claim 1, wherein each conductor consists of a plurality of copper wires stranded together, a first semi-conducting shield applied over said copper wires, a layer of insulating material applied over said first shield, a second semi-conducting shield applied over said insulating layer, and copper tapes applied over said second semi-conducting shield.

7. A self-supporting cable as defined in claim 1, wherein said filler is selected from the group consisting of polypropylene, jute and rubber materials.

8. A self-supporting cable as defined in claim 1, wherein said jacket is made of a material selected from the group consisting of polyvinyl chloride, polyethylene, neoprene, chlorosulphonated polyethylene, polyurethane and natural rubber.

* * * * *